US009938838B2

(12) United States Patent
Witz et al.

(10) Patent No.: US 9,938,838 B2
(45) Date of Patent: Apr. 10, 2018

(54) COMPOSITE TURBINE BLADE FOR HIGH-TEMPERATURE APPLICATIONS

(71) Applicant: Ansaldo Energia IP UK Limited, London (GB)

(72) Inventors: Gregoire Etienne Witz, Birmenstorf (CH); Michael Stuer, Niederrohrdorf (CH); Hans-Peter Bossmann, Lauchringen (DE)

(73) Assignee: ANSALDO ENERGIA IP UK LIMITED, London (GB)

( * ) Notice: Subject to any disclaimer, the term of this patent is extended or adjusted under 35 U.S.C. 154(b) by 179 days.

(21) Appl. No.: 14/601,311

(22) Filed: Jan. 21, 2015

(65) Prior Publication Data

US 2015/0218954 A1 Aug. 6, 2015

(30) Foreign Application Priority Data

Jan. 31, 2014 (EP) ..... 14153381

(51) Int. Cl.
*F01D 5/14* (2006.01)
*F01D 5/28* (2006.01)
(Continued)

(52) U.S. Cl.
CPC ..... *F01D 5/282* (2013.01); *F01D 5/147* (2013.01); *F01D 5/20* (2013.01); *F01D 5/3007* (2013.01);
(Continued)

(58) Field of Classification Search
CPC ..... F01D 5/282; F01D 5/147; F01D 5/3007; F01D 5/3053; F01D 5/3084; F01D 5/3092
See application file for complete search history.

(56) References Cited

U.S. PATENT DOCUMENTS 8,167,573 B2 * 5/2012 Merrill ..... F01D 5/288 416/224
8,475,132 B2 * 7/2013 Zhang ..... F01D 5/147 416/225
(Continued)

FOREIGN PATENT DOCUMENTS

EP 0 712 382 B1 9/1998
EP 2 497 905 A2 9/2012
(Continued)

OTHER PUBLICATIONS

Y. Waku et al, A ductile ceramic eutectec composite with high strength at 1,873K, Sep. 1997, pp. 49-52.*
(Continued)

*Primary Examiner* — Logan Kraft
*Assistant Examiner* — Sabbir Hasan
(74) *Attorney, Agent, or Firm* — Buchanan Ingersoll & Rooney PC

(57) ABSTRACT

A composite turbine blade for high-temperature applications such as gas turbines or the like includes a root for mounting the blade in a corresponding circumferential assembly groove of a rotor and an airfoil connected to said root. An inner carrying structure is provided extending at least over a portion of the root as well as at least a portion of said airfoil. The inner carrying structure is made of a high strength eutectic ceramic and the airfoil is made of a ceramic matrix composite (CMC) material.

15 Claims, 4 Drawing Sheets

(51) Int. Cl.
*F01D 5/30* (2006.01)
*F01D 5/20* (2006.01)

(52) U.S. Cl.
CPC ..... *F01D 5/3053* (2013.01); *F01D 5/3061* (2013.01); *F01D 5/3084* (2013.01); *F01D 5/3092* (2013.01); *F01D 5/284* (2013.01); *F05D 2300/6033* (2013.01); *F05D 2300/611* (2013.01)

(56) References Cited

U.S. PATENT DOCUMENTS

| | | | | |
|---|---|---|---|---|
| 8,871,297 | B2 * | 10/2014 | Barnett ..... | B22F 1/0018 427/142 |
| 2003/0207155 | A1 | 11/2003 | Morrison et al. | |

FOREIGN PATENT DOCUMENTS

| | | | |
|---|---|---|---|
| EP | 2 500 519 | A2 | 9/2012 |
| EP | 2 540 975 | A2 | 1/2013 |
| EP | 2 578 553 | A2 | 4/2013 |

OTHER PUBLICATIONS

Llorca J. et al. "Directionally solidified eutectic ceramic oxides", Progress in Materials Science, Pergamon Press, GB, vol. 51, No. 6, Aug. 1, 2006, pp. 711-809, XP027932250, ISSN:0079-6425.
Chinese Office Action for Chinese Application 201510048222.5 dated May 27, 2017.
Chinese Office Action for Chinese Application 201510048222.5 dated May 27, 2017 (English Translation).

* cited by examiner

COMPOSITE TURBINE BLADE FOR HIGH-TEMPERATURE APPLICATIONS

CROSS-REFERENCE TO RELATED APPLICATIONS

This application claims priority to European application 14153381.0 filed Jan. 23, 2014, the contents of which are hereby incorporated in its entirety.

TECHNICAL FIELD

The present invention relates to a composite turbine blade for high-temperature applications, such as gas turbines or turbine engines, which are adapted for a mounting and an assembly on a rotor or disk of a turbine or engine in order to provide different turbine stages, in particular in the hot gas path.

BACKGROUND

With the purpose to increase the efficiency and performance of gas turbine engines, for example, there is a need for turbines, which can be operated at higher temperatures as compared to conventional gas turbines. In order to meet these operational requirements, it was in the past suggested to use so-called superalloys, e.g. nickel-based superalloys, for the manufacturing of turbine blades. However, these materials are susceptible to corrosion and limited to a certain range of high temperatures. Furthermore, in the prior art, different methods for cooling the high-temperature turbine blades for example with cooling air supply have been suggested. However, with an increase in the temperatures, the amount of necessary cooling air is increased with the decrease of the overall performance and efficiency of the gas turbines. To further increase the temperature capability of turbine blades made of superalloys, ceramic thermal barrier coating (TBCs) have been suggested. However, also with such turbine blades having a ceramic coating there are limitations with regard to the range of high temperature applications and the manufacturing of them is rather complex.

Furthermore, turbine blades for high-temperature gas turbines were suggested in the past, which are realized of a ceramic materials: for example, in EP 0 712 382 B1 the use of eutectic ceramic fibers for the manufacturing of turbine blades is disclosed, in which the ceramic eutectic fibers are used to manufacture a ceramic matrix composite.

Also US 2003/0207155 A1 describes high-temperature turbine blades made of ceramic materials, in which cooling ducts are provided for cooling the turbine blades during the operation of the gas engine in high-temperature ranges.

However, these known turbine blades for high-temperature applications have the disadvantage that they require either separate cooling means, such as cooling ducts, or do not achieve the required mechanical properties, in particular a high strength to resist the increased loads in some portions or locations of such turbine blades. A further problem of known turbine blades made of ceramic materials is that they are characterized by a rather low resistance to foreign object damages. Furthermore, the above-described eutectic ceramic materials have a relatively low fracture toughness, so that the application of such ceramic materials in the realization of turbine blades and in particular the airfoil of such blades is rather limited.

SUMMARY

In view of these disadvantages, it is a problem of the present invention to provide a composite turbine blade for high-temperature applications that combines at the same time a high resistance to foreign object damages and a high fracture toughness and a high temperature capability or operable temperature range.

This problem is solved by means of a composite turbine blade with the features of claim 1. Advantageous preferred forms of realization and further developments are the subject matter of the dependent claims.

The composite turbine blade according to the present invention has a root for mounting in a corresponding assembly groove of a rotor, as well as an airfoil connected to said root, whereby an inner carrying structure is provided, extending at least over a portion of said root as well as a portion of said airfoil, and it is characterized in that said inner carrying structure is made of a high-strength eutectic ceramic and that said airfoil is made of a ceramic matrix composite (CMC) material. Said inner carrying structure is provided at least in some portions of the root of the blade as well as the airfoil connected to the root. With the use of a high-strength eutectic ceramic for the inner carrying structure, the turbine blade has the required increased mechanical properties for the application in high-temperature ranges of such gas turbines.

The airfoil itself is made of a different ceramic material, namely a ceramic matrix composite material or a so-called CMC material. With this material, the aerodynamic shape of the airfoil is formed, which provides in this portion of the blade a high resistance to foreign object damages, as well as a good erosion-resistant structure. The erosion resistance can be provided directly by the CMC material or by one or more coating layers applied on the surface of the CMC. Such a CMC material is furthermore characterized by a high fracture toughness such that a long lifetime of the turbine blade is achieved. Since the different elements or portions of the turbine blade are all realized of different ceramic materials adapted to their respective functions and locations, the turbine blade is specifically adapted also for high-temperature applications, in particular in temperature ranges around or above 1,500° C. By the combination of different ceramic materials according to the present invention with different elements or components of the turbine blade, the desired mechanical and temperature-related properties at different locations of the turbine blade are achieved: the root section of the turbine blade, for example, needs to carry the load of the whole blade, but is usually exposed to relatively low temperatures during the operation of the gas turbine engine. On the other hand, this root section requires for the assembly and disassembly small tolerances with regard to the shape. Therefore, the root of the turbine blade is not required to be made of a high temperature resistant ceramic material, such as the airfoil, but can be realized in other ceramic materials and/or a combination of metal and ceramic materials. The inner carrying structure, which is realized of a high-strength eutectic ceramic is an inner part of the turbine blade such that it is not in direct contact with the gases of high temperatures and is not subject to foreign objects or wear, as it is the case for the airfoil itself.

On the other hand, the airfoil is according to the invention realized of a ceramic matrix composite material, which guarantees the high mechanical properties as well as the resistance to increased temperatures of up to 1,500° C. or even 1,800° C. With this new design of a composite ceramic turbine blade, the cooling requirements are considerably reduced. Depending on the mechanical loading of the part and the hot gas temperature, it is possible that such a composite blade does not require active cooling, for instance through the supply of cooling air. The materials of the critical components are of a high strength at high temperature ranges. The reduction of cooling air leads to an overall cost reduction and an increase in the performance and efficiency of the turbine engine.

Besides the specific adaption to high-temperature applications, the composite turbine blade of the invention has also advantages with regard to the weight and erosion resistance. As compared to metal materials or metal alloys, the use of different types of ceramic materials within one and the same turbine blade avoids also problems with regard to corrosion. With such a composite design of the ceramic turbine blade of the invention, the combination of different ceramic (and/or metal) materials provides the respective desired mechanical and temperature-related properties at different locations of the turbine blades having different functions in the complete blade construction. The main function of the inner carrying structure is to carry the loads and to securely connect and retain the airfoil to the root section of the turbine blade. On the other hand, the airfoil itself is specifically adapted to high temperatures and possible foreign object damages or wear requirements during the operation of such gas turbines or the like.

According to an advantageous form of realization of the invention, the airfoil of the turbine blade is realized in a fiber-reinforced ceramic matrix composite (CMC) material. With the use of a fiber-reinforced CMC material, the mechanical strength is further increased and a high fracture toughness is provided. The fibers for the reinforcement of the ceramic matrix composite material can either be also eutectic ceramic fibers or fibers of a different material, e.g. based on an oxide fiber (such as $Al_2O_3$, mullite, yttria stabilized zirconia, $HfO_2$ $ZrO_2$ or $Y_2O_3$). However, according to the present invention, it is preferred to use a ceramic eutectic fiber for the purpose of the reinforcement of the material of the airfoil.

According to a further advantageous aspect of the invention, the root section or root of the turbine blade is made of a eutectic ceramic material with an outer metal surface coating. With the metal coating of the root, the root section can be shaped within small tolerances with regard to the required form for the purpose of the mounting and disassembly of the turbine blade within a corresponding circumferential assembly groove of the gas turbine. It is therefore possible to provide the root of the turbine blade with a tight finishing and at the same time with the capacity to withstand the various types of loads during the operation and the assembly or disassembly of the blade. Nevertheless, the turbine blade has a comparatively low weight and is specifically adapted to applications in high-temperature ranges due to the eutectic ceramic material.

According to a further advantageous embodiment of the invention, the ceramic matrix composite material of the airfoil is directly shaped on said inner carrying structure in a near net shape of a predetermined form of the blade. That means, the airfoil is directly shaped or casted on the eutectic ceramic material of the inner carrying structure. A tight joining without requiring separate joining means is thereby achieved. For example, after a curing of the two components and possibly further components of the turbine blade, the finished composite turbine blade structure is given, which requires only a minimal machining of the outer shape of the airfoil. It is hereby also possible to easily reach the predefined manufacturing tolerances of the different components, in particular the airfoil made of the ceramic matrix composite material with or without reinforcement fibers.

According to a further advantageous embodiment of the invention, the inner carrying structure of the turbine blade has at its free end opposite to a root section of the blade an essentially anchoring shaped cross-section. With such an anchoring shaped cross-section at the free end of the inner carrying structure, the fixation resistance to the outer airfoil is increased. For example, the material of the airfoil can directly be shaped on and around the anchoring shaped end of the inner carrying structure. Furthermore, the amount of required material is reduced by this feature, and the total weight of the turbine blade is thereby also reduced.

According to a further advantageous form of realization of the invention, the root of the turbine blade has a fir-tree-type cross-section for engagement in a corresponding cross-section of said assembly groove of the gas turbine engine. The turbine blade may hereby directly be assembled within a corresponding mounting groove without the requirement of additional retaining means, such as clamps or the like. With such a form-fitting engagement, the secure and long-term retaining of the turbine blade in its precise predefined location within the gas turbine is furthermore guaranteed.

According to a further advantageous embodiment of the invention, the composite turbine blade is provided with means for joining said airfoil to said inner carrying structure. With additional means for joining the airfoil to the inner carrying structure, the retaining force between these components is enhanced. Also in case of high loads acting on the airfoil during the operation of the gas turbine, the assembly and the precise positioning of the turbine blade are maintained.

As a means for joining the airfoil to the inner carrier structure, the turbine blade of the invention may be provided with a ceramic slurry at respective contact locations between the outer airfoil and the inner carrying structure, which slurry is sintered during a curing of the turbine blade. Hereby, a solid ceramic joint is automatically formed when the airfoil and the inner carrying structure are cured. By providing a ceramic slurry at respective contact locations, a long-lasting joining of these ceramic components of the turbine blade is realized.

According to a further advantageous embodiment in this respect, the means for joining the airfoil and the inner carrying structure of the turbine blade comprise form features, such as holes and protuberances, in a form to realize a mechanical lock between the elements of said turbine blade. If, for example, the inner carrying structure is provided with a number of holes or indentations, the material of the airfoil casted on the inner carrying structure will fill out the respective holes or indentations. Hereby, a secure holding effect is realized such that the different components of the turbine blade are securely fixed to one another. Furthermore, such form features do not require additional elements or components for the joining of the airfoil to the inner carrying structure.

According to a further alternative form of realization of the invention in this respect, the means for joining the airfoil to the inner carrying structure comprise several hole and pin combinations. Such combinations of several holes and pins require little space in the construction of the turbine blade and provide a secure fixation. According to an advantageous aspect in this respect, the pins can be made of a dense ceramic material such that the high temperatures during the operation of the turbine will not lead to a harmful deformation between the joining means and the other components of the composite turbine blade. In an alternative form of realization, also ceramic inserts can be used for the joining and fixation of the outer airfoil to the inner carrying structure. Similar advantageous effects as compared to ceramic pins inserted into holes can hereby be achieved.

According to a further advantageous form of realization of the invention, the airfoil of the composite turbine blade has a hollow shape such that inner cavities between respective contact locations with said inner carrying structure are provided. A heat transfer from the outer airfoil to the inner carrying structure is thereby limited. Furthermore, the total weight of the turbine blade is also reduced. And last but not least, the necessary amount of material for forming the airfoil is also limited. Nevertheless, the airfoil is securely fixed to the inner carrying structure by means of the several contact locations, at which the material of the airfoil is either directly casted on the inner carrying structure or is attached to the inner carrying structure by means of the above-described means for joining.

BRIEF DESCRIPTION OF THE DRAWINGS

In the following, the composite turbine blade according to the present invention will be described in more detail on the basis of several examples of realization and with reference to the attached drawings. In the drawings.

DETAILED DESCRIPTION

Figure 1:
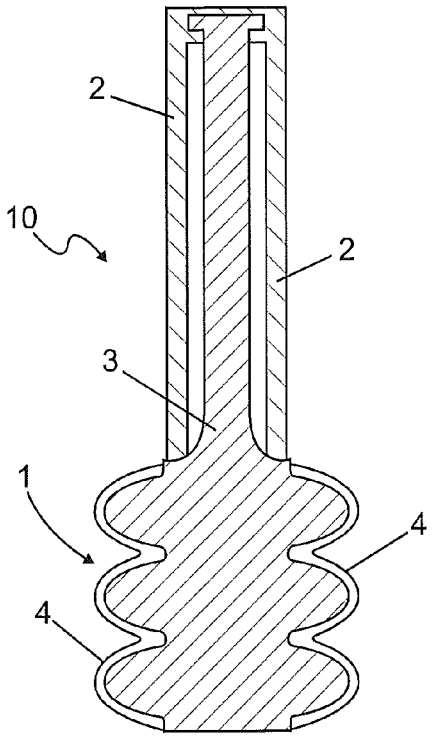
FIG. 1 is a schematic cross-section of a first example of realization of a composite turbine blade according to the invention.

In the drawings FIG. 1 to FIG. 6, several examples of realization of a composite ceramic turbine blade 10 according to the invention are shown, which will be described in the following. According to the invention, a high-temperature composite turbine blade 10 is provided, in which different parts of the turbine blade 10 are realized in different types of ceramic materials. Depending on the respective functions, positions and requirements of the different parts or components of the turbine blade 10, a specific combination of ceramic materials and/or metal materials or alloys thereof is used to provide the required and desired properties at the different locations of the turbine blade, such as the airfoil 2, the root 1 and an inner carrying structure 3. Due to this new combination of different ceramic materials in the composite turbine blade 10 according to the invention, a turbine blade 10 is provided which is adapted to a use in high-temperature applications, such as temperatures of up to 1,500° C. and even higher, of up to 1,800° C. Nevertheless, the composite ceramic turbine blade 10 of the invention is capable to withstand the various types of loads brought during the assembly and the operation of a gas turbine, for example. The airfoil 2 of the turbine blade 10 according to the invention is realized with a high fracture toughness ceramic material, such as a ceramic matrix composite material. On the other hand, the inner carrying structure 3 is made of a high-strength ceramic material, i.e. an eutectic ceramic material, examples of which will be given in the following description.

As shown in FIG. 1 regarding a first examples of realization of a turbine blade 10 of the present invention, the basic components of the turbine blade 10 are an airfoil 2 and a root 1 with a specific cross-section shape for mounting the turbine blade 10 within a mounting groove on a rotor of the turbine, as it is conventionally known in the technical field of gas turbines. In this example of realization, the root 1 has a fir-tree-type cross-section with three protrusions at either side of the blade 10. In the example shown in FIG. 1, the root 1 is made of a material of an inner carrying structure 3, which according to the invention is a high-strength eutectic ceramic material. The inner carrying structure 3 extends from the root 1 upwards to the free end of the turbine blade 10 (upper end in FIG. 1) with a reduced diameter and an approximately anchoring shaped end portion. On this upper section of the inner carrying structure 3, the airfoil 2 is directly shaped on and around the eutectic material of the inner carrying structure 3. The T-portion is so to speak embedded in the material of the airfoil 2. In this example of realization, the airfoil 2 has an approximately U-shaped cross-section (inversed "U"). Between the inner carrying structure 3 and the airfoil 2, hollow spaces remain. Due to the upper end of the inner carrying structure 3 with an approximately anchoring shaped cross-section, the airfoil 2 is securely held and fixed on the inner carrying structure 3. For the airfoil 2, which provides the required aerodynamic shape and has to be erosion-resistant as well as be able to withstand foreign object damages, a different ceramic material as compared to the inner carrying structure 3 is used, namely a ceramic matrix composite (CMC) material, according to the present invention. Therefore, the airfoil 2 is characterized by a high fracture toughness material. The ceramic matrix composite material can be provided with or without reinforcement fibers.

Since the eutectic ceramic material used for the inner carrying structure 3, which forms also the inner part of the root 1, has a relatively low fracture toughness, the root 1 can be in this example of realization (FIG. 1) provided with an outer metal surface coating 4. The outer metallic coating 4 is, for example, 0.1-2 mm thick and is applied on the lower part of the inner carrying structure 3 made of the eutectic ceramic material. The metal coating 4 can be machined afterwards to reach the required tight manufacturing tolerances for the installation of the blade in a correspondingly formed mounting groove of a rotor of the turbine. With this metallic outer coating 4, the predefined shape of the root 1 is realized within small tolerances such that a precise and secure mounting and assembly of the turbine blade 10 is possible. Thereby, the root 1 of the turbine blade 10 is adapted to withstand the various types of loads during the installation and the operation of the gas turbine, even though it is all in all realized almost only of ceramic materials, which are specifically adapted to high-temperature applications. Due to this specific construction of a ceramic turbine blade 10, the required cooling is considerably reduced or even not necessary at all. The overall turbine efficiency and output of the engine is thereby improved. Furthermore, the turbine blade 10 is very erosion-resistant and does not have oxidation problems, as is the case with turbine blades of the prior art made of metal alloys or even so-called superalloys.

The latter furthermore require a higher amount of cooling air, which reduces the overall turbine efficiency.

Figure 2:
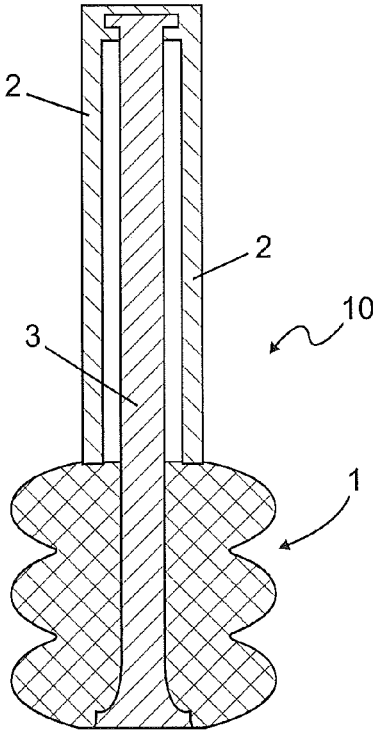
FIG. 2 is a schematic cross-section of a second example of realization of a composite turbine blade according to the invention.

A second example of realization of a composite turbine blade of the present invention is shown in the schematic cross-section of FIG. 2. Only the differences as compared to the above first example of realization will be described in the following. For the other parts, the above description of the first embodiment applies. Here, the inner carrying structure 3 is a longitudinal, rectilinear component with an approximately I-shaped cross-section. The inner carrying structure 3 extends from the bottom end of the turbine blade 10 up to the free end on the side of the airfoil 2. The airfoil 2 has a similar form as compared to the first example of realization, namely a cross-section of approximately an inversed "U". The root 1 is made of a metallic material with an inner central opening, through which the lower part of the rectilinear inner carrying structure 3 passes. Therefore, in this example of realization (FIG. 2), there is not provided an outer metal coating, but the root 1 is formed as a rather solid metal component. Also here, the inner carrying structure 3 is realized of a high-strength eutectic ceramic such that the required strength and rigidity is given for carrying the different types of loads acting on the turbine blade 10 during operation. On the other hand, also here the airfoil 2 is made of a different ceramic material, namely a ceramic matrix composite (CMC) material. The airfoil 2 is for example directly formed on the Anchoring shaped free end of the inner carrying structure 3 after the forming of the root 1 made of a metal material or a metal alloy material. With this form of realization, the strength of the turbine blade 10 is furthermore increased due to the metal material used for the root 1 in the lower part of the turbine blade 10, which is usually not exposed to the higher temperatures, since the root 1 is a cooler area of the turbine blade 10. The central inner carrying structure 3 of a eutectic ceramic material is first casted without the root 1. Afterwards, the metal material or metal alloy material for the blade root 1 is casted directly on the inner carrying structure 3 and is machined to the final predefined root shape within the required small manufacturing tolerances. After this, a ceramic matrix composite (CMC) material is directly shaped on the inner carrying structure 3 in order to form the airfoil 2 of a high fracture toughness material. The airfoil 2 has therefore a high resistance to erosion and foreign object damages.

Figure 3:
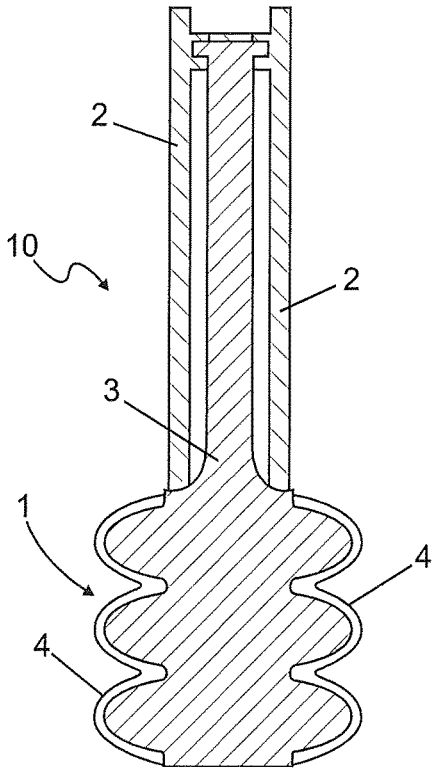
FIG. 3 is a schematic cross-section of a third example of realization of a composite turbine blade according to the invention.

A third example of realization of a turbine blade 10 according to the present invention is shown in FIG. 3. In this example of realization, the anchoring of the airfoil 2 on the inner carrying structure 3 is different as compared to the above-described embodiments: the eutectic ceramic material forms here most of the root section 1, so that the two lower protrusions on respective sides of the root 1 are coated with a metal material or metal alloy material. The two upper protrusions of the fir-tree-type cross-section of the root 1 are provided on the outer surface with the ceramic matrix composite (CMC) material of the airfoil 3, which extends also here as an overall hollow component around the upper reduced diameter part of the inner carrying structure 3. On the side of the free end of the airfoil 2, there is provided an approximately H-shaped cross-section with a through-hole, through which the anchoring shaped upper end of the inner carrying structure 3 extends. Due to this specific shape of the airfoil 2 casted on the upper part of the root 1 and around the upper section of the inner carrying structure 3, the airfoil 2 is securely retained on the inner carrying structure 3. The joining between the CMC material of the airfoil 2 and the inner carrying structure 3 is therefore realized due to the application or casting of the different types of ceramic materials on one another. Therefore, in this embodiment no separate means for joining the different components of the composite turbine blade 10 are required. This simplifies the manufacturing process.

Figure 4:
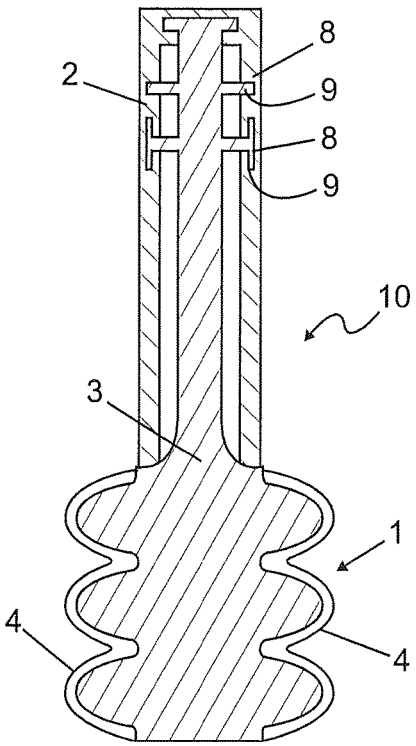
FIG. 4 is a schematic cross-section of a fourth example of realization of a composite turbine blade according to the invention.

A further example of realization of a turbine blade 10 according to the present invention with a different type of joining the respective components is shown in the schematic cross-section of FIG. 4. In the upper section, the inner carrying structure 3 is here not a rectilinear, straight portion, but is provided with a number of form features for example in the form of holes 8 and protuberances 9, which have the function of a secure anchoring of the material of the outer airfoil 2. For the joining of the airfoil 2 to the inner carrying structure 3, the upper free end of the inner carrying structure 3 has an essentially anchoring shaped cross-section, around which the ceramic matrix composite material of the airfoil 2 is casted. Furthermore, the inner carrying structure 3 is provided with two opposite, vertically extending protuberances 9, which are embedded within holes 8 in the material of the airfoil 2. The protuberances 9 can have different forms, such as the rectilinear form shown in the upper section of FIG. 4 an anchoring shaped form below the rectilinear protuberances, which increases the anchoring effect for the joining of the airfoil 2 onto the inner carrying structure 3. Hereby, a kind of mechanical lock is given after curing the complete composite ceramic turbine blade 10. The form features (protuberances and holes) can be shaped during the casting of the eutectic ceramic material of the inner carrying structure and the casting of the CMC material of the outer airfoil 2.

In an alternative form of realization as compared to the embodiment shown in FIG. 4, the holes can be provided in the material of the inner carrying structure 3, and the holes are afterwards filled with the CMC material of the outer airfoil 2, thereby forming protuberances according to the present invention. Also different types of protuberances and/or holes can be used for anchoring the outer airfoil 2. As regards the root 1, also here a part of the CMC material of the airfoil 2 is casted around the root section 1 (upper two protrusions), whereas in the lower part a metal coating 4 is applied on the outer surface of the root 1. This metal coating guarantees the manufacturing within the tight or small tolerances required for the assembly of the turbine blade 10 within the mounting groove of a rotor of a gas turbine.

Figure 5:
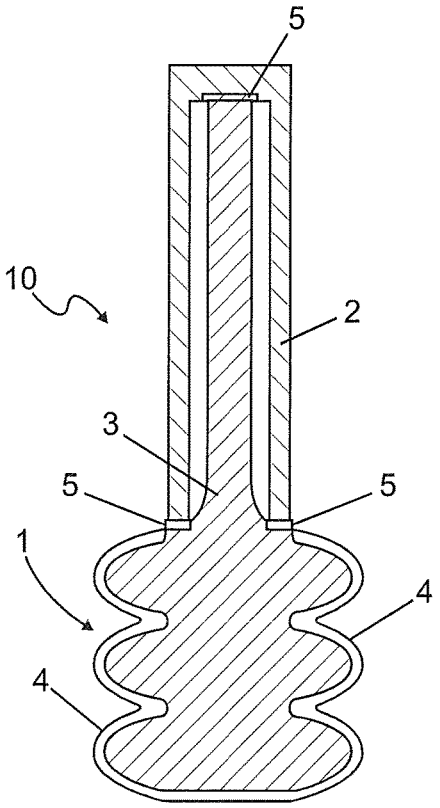
FIG. 5 is a schematic cross-section of a fifth example of realization of a composite turbine blade according to the invention.

A further possibility of a joining of the different components of the composite ceramic turbine blade 10 according to the present invention is shown in the schematic drawing of FIG. 5. This embodiment of FIG. 5 is similar to the embodiment described above with reference to FIG. 1, with the following differences: the upper free end of the inner carrying structure 3 has a straightforward rectilinear cross-section without an anchoring shaped end. The airfoil 2 has a cross-section of an approximately inversed U-shape and is attached to the inner carrying structure 3 made of the eutectic ceramic material on several different contact positions by means of a ceramic slurry 5. In case of this example of realization, there are provided three different contact positions between the airfoil 2 and the inner carrying structure 3: the upper free end of the carrying structure 3 is a first contact location, and the lower free ends of the arms of the U-shaped airfoil 2 on the side of the root 1 form two other contact locations.

On these contact locations and possibly further contact locations, a so-called ceramic slurry is applied after the shaping of the inner carrying structure 3 made of a high-strength eutectic ceramic. Afterwards, the CMC material of the outer airfoil 2 is shaped in the form shown in FIG. 5, and the complete turbine blade is then cured such that the ceramic slurry will sinter and will finally form a solid ceramic joint. Also by means of this type of joining a secure fixation of the different types of ceramic materials is realized. Nevertheless the different parts of the turbine blade, namely the inner carrying structure 3, the root 1 and the airfoil 2, are specifically adapted to their respective functions, positions and requirements in high-temperature applications, such as modern gas turbines. Also in this embodiment shown in FIG. 5, a metal coating 4 is provided on the outer surface of the root 1. This improves the fracture toughness of this root 1 and enables the realization of the root 1 within small manufacturing tolerances, as required for the assembly of the turbine blade 10.

Figure 6:
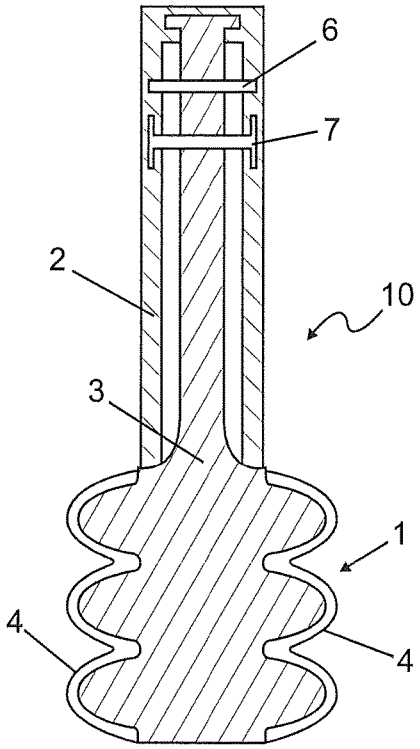
FIG. 6 is a schematic cross-section of a sixth example of realization of a composite turbine blade according to the invention.

A further possibility of joining the outer airfoil 2 and the inner carrying structure 3 with the root 1 to another is shown in the schematic cross-section of FIG. 6. As a means for joining, here separate joining components 6, 7 are used in two different exemplary forms. The joining means can for example be provided in the form of pins 6, which are inserted in respective holes of the material of the inner carrying structure 3 and/or the CMC material of the outer airfoil 2. These pins 6 can for example be realized in a ceramic material or in any other appropriate material, such as a metal material or a metal alloy.

A further possibility of a separate joining element is the use of so-called ceramic inserts 7 as shown in the schematic drawing of FIG. 6. The ceramic insert 7 has here an approximately double T cross-section and is embedded within the CMC material of the airfoil 2. By means of this, the pins 6 and/or the ceramic inserts 7 provide a secure anchoring of the outer airfoil 2 to the inner carrying structure 3, which has such a type of ceramic material that a high strength is given (i.e. eutectic ceramic material). The pins 6 and/or the inserts 7 can for example be manufactured by means of a sintering of an appropriate ceramic material. Also the embodiment shown in FIG. 6 has in the root section an outer metal coating or a coating of a metal alloy material. This turbine blade 10 according to FIG. 6 can be manufactured by first casting the inner carrying structure 3 with the specific eutectic ceramic material such that holes for the installation of the pins 6 or inserts 7 are realized. The shaping or casting of the airfoil 2 will lead to an embedding of the pins 6 or inserts 7, which may be formed of a dense ceramic material (eutectic or non-eutectic). Thereby, a secure anchoring of the airfoil 2 is given after the curing of the thereby completed composite turbine blade 10.

Figure 7:
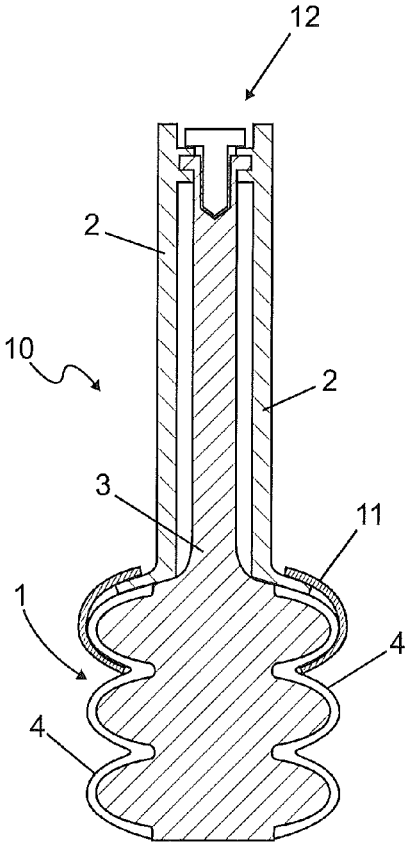
FIGS. 7 and 8 are further schematic cross-sections of examples of realization of a composite turbine blade according to the invention.

Another possibility of joining the airfoil CMC structure to the carrying structure is illustrated in FIG. 7. It comprises to mechanically fasten the CMC (the airfoil 2) on the carrying structure 3 after manufacturing of both parts independently. Various fixation designs can be used, for instance by using a U-shaped fixing means 11 that can be installed by sliding them over the grooves or the tip and positively locks the CMC airfoil 2 with the root 1.

The U-shaped fixing means 11 may be of metal or a ceramic material, preferably CMC.

Additionally or alternatively at the top of the airfoil 2 a screw 12 may be used to fasten the airfoil 2 to the carrying structure 3.

Figure 8:
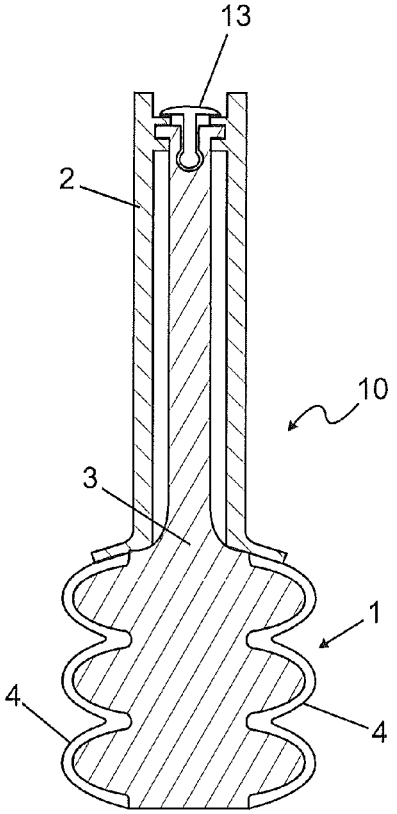

Additionally or alternatively at the top of the airfoil 2 positive locking means 13, preferably made of CMC, may be used to fasten the airfoil 2 to the carrying structure 3 as illustrated in FIG. 8.

Other possibilities are to use ceramic or metallic screws depending on the local loading condition. Such designs provide the benefit to allow easy removal of the ceramic airfoil 2, to replace only the CMC airfoil 2 and to reuse the carrying structure 3. This ensures a cheap and efficient reconditioning process for the airfoil 2.

In all of the above-described examples of realization (FIG. 1 to FIG. 7), the ceramic matrix composite (CMC) material used for the outer airfoil 2 can be any CMC material known to the person skilled in the art. The CMC material can for example be based on an oxide fiber, such as $Al_2O_3$, mullite, $HfO_2$, $Y_2O_3$, or the like. Also ceramic eutectic fibers can be used for the reinforcement of the CMC material of the airfoil 2. As regards the possible materials used for the inner carrying structure 3, any eutectic material known to a person skilled in the art can be used as a complete structure without fibers or a structure with reinforcement fibers. For example, the ceramic eutectic materials, which are used for the composite turbine blade 10 of the present invention for realizing the inner carrying structure 3, can be chosen from the following eutectic ceramics: $Al_2O_3$—$Y_2O_3$, $Cr_2O_3$—$SiO_2$, MgO—$Y_2O_3$, CaO—NiO, and CaO—MgO, $ZrO_2$—$Al_2O_3$, YAG-$ZrO_2$, YAP—$ZrO_2$, $Al_2O_3$—$Al_2TiO_5$, MgO—$Mg_2AlO_4$, $HfO_2$—$Al_2O_3$, $Sc_2O_3$—$SC_4Zr_3O_{12}$, $Sc_2O_3$—$HfO_2$, or the like.

The invention claimed is:

1. A composite turbine blade comprising:

a root, the root configured to mount said blade in a corresponding circumferential assembly groove of a rotor;

an airfoil connected to said root, an inner carrying structure extending from at least a portion of said root to a portion of said airfoil, said inner carrying structure connected to the airfoil and the root such that the inner carrying structure is positioned inside of an external surface of the root and positioned inside of an external surface of the airfoil, said inner carrying structure comprised of a eutectic ceramic material;

a joining mechanism coupling said airfoil to said inner carrying structure, said joining mechanism comprised of a sintered ceramic slurry at respective contact locations between said airfoil and said inner carrying structure that forms at least one joint between the inner carrying structure and the airfoil;

the root and airfoil fully enclosing all external surfaces of the inner carrying structure, said airfoil comprised of a ceramic matrix composite (CMC) material.

2. The composite turbine blade according to claim 1, wherein said airfoil is comprised of a fiber-reinforced material.

3. The composite turbine blade according to claim 1, wherein said exterior surface of said root is comprised of an outer metal surface coating.

4. The composite turbine blade according to claim 1, wherein the CMC material for said airfoil is directly shaped on said inner carrying structure in a shape of a predetermined form of the blade.

5. The composite turbine blade according to claim 1, wherein said inner carrying structure has a shaped cross-section at an end of the inner carrying structure within the airfoil that is shaped for attachment to the airfoil.

6. The composite turbine blade according to claim 1, wherein said root has a fir tree cross section for engagement in a corresponding cross-section of said assembly groove of the rotor.

7. The composite turbine blade according to claim 1, wherein airfoil is mechanically fixed on the inner carrying structure.

8. The composite turbine blade according to claim 1, wherein said airfoil has a hollow shape that defines inner cavities between respective contact locations with said inner carrying structure.

9. A composite turbine blade for a gas turbine comprising:

a root;

an airfoil, said airfoil comprised of a ceramic matrix composite (CMC) material;

an inner carrying structure extending from said root to said airfoil, said inner carrying structure connected to the airfoil and the root such that the inner carrying structure is positioned inside of an external surface of the root and positioned inside of an external surface of the airfoil, said inner carrying structure comprised of a eutectic ceramic material;

the external surface of the root comprised of a metal coating that coats at least a portion of the inner carrying structure positioned within the root;

the external surface of the airfoil comprised of the CMC material;

the airfoil connected to the inner carrying structure via a joining mechanism, the root and airfoil fully enclosing all external surfaces of the inner carrying structure, the joining mechanism comprising one of:

ceramic fasteners extending between the airfoil and the inner carrying structure, metallic fasteners extending between the airfoil and the inner carrying structure, pins extending from holes formed within the inner carrying structure to the airfoil, inserts extending from holes formed within the inner carrying structure to the airfoil, and a solid ceramic joint between the airfoil and the inner carrying structure, the solid ceramic joint comprising a sintered ceramic slurry.

10. The composite turbine blade of claim 9, wherein the joining mechanism is the ceramic fasteners extending between the airfoil and the inner carrying structure.

11. The composite turbine blade of claim 9, wherein the joining mechanism is the metallic fasteners extending between the airfoil and the inner carrying structure.

12. The composite turbine blade of claim 9, wherein the joining mechanism is the pins extending from holes formed within the inner carrying structure to the airfoil.

13. The composite turbine blade of claim 9, wherein the joining mechanism is the inserts extending from holes formed within the inner carrying structure to the airfoil.

14. The composite turbine blade of claim 9, wherein the joining mechanism is the solid ceramic joint comprising the sintered ceramic slurry.

15. The composite turbine blade of claim 14, wherein the airfoil has an inverted U shape that receives the inner carrying structure.

* * * * *